US009219327B2

(12) United States Patent
Ohyama

(10) Patent No.: US 9,219,327 B2
(45) Date of Patent: Dec. 22, 2015

(54) WATERPROOF FLAT CABLE CONNECTOR AND METHOD FOR MANUFACTURING SAME

(71) Applicant: Yazaki Corporation, Tokyo (JP)

(72) Inventor: Kouichi Ohyama, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 14/051,663

(22) Filed: Oct. 11, 2013

(65) Prior Publication Data

US 2014/0045370 A1 Feb. 13, 2014

Related U.S. Application Data

(63) Continuation of application No. PCT/JP2012/060637, filed on Apr. 19, 2012.

(30) Foreign Application Priority Data

Apr. 20, 2011 (JP) ..... 2011-093664

(51) Int. Cl.
*H01R 13/52* (2006.01)
*H01R 43/00* (2006.01)
(Continued)

(52) U.S. Cl.
CPC ..... *H01R 13/52* (2013.01); *H01R 13/5205* (2013.01); *H01R 43/005* (2013.01); *H01R 12/59* (2013.01); *H01R 13/405* (2013.01); *H01R 43/24* (2013.01); *Y10T 29/4922* (2015.01)

(58) Field of Classification Search
CPC ..... H01R 13/5205; H01R 2201/26; H01R 13/52; H01R 43/005; H01R 13/5202; H01R 13/521; H01R 13/5219; H01R 13/5845; H01R 13/5221; H01R 4/22
USPC ..... 439/271–272
See application file for complete search history.

(56) References Cited

U.S. PATENT DOCUMENTS 3,568,131 A * 3/1971 Kennedy ..... 439/155
5,057,650 A * 10/1991 Urushibata ..... H01R 13/504 174/72 A (Continued)

FOREIGN PATENT DOCUMENTS

CN 1 01 401 263 A 4/2009
CN 101919124 A 12/2010

(Continued)

OTHER PUBLICATIONS

International Preliminary Report on Patentability (PCT/IB/338, PCT/IB/373, and PCT/ISA/237), issued by the International Searching Authority in counterpart International Patent Application No. PCT/JP2012/060637.

(Continued)

*Primary Examiner* — Truc Nguyen
(74) *Attorney, Agent, or Firm* — Sughrue Mion, PLLC

(57) ABSTRACT

A waterproof flat cable connector includes a flexible flat cable which has a conductive wire and an insulative film which covers the conductive wire, a terminal which is connected to the conductive wire, an insulative covering part integrally molded with the flat cable to cover a junction part of the conductive wire and the terminal, and a connector housing which is fitted with a connection mating connector to connect the terminal with a connection mating terminal. The connector housing is integrally molded with a surface of the insulative covering part. The insulative covering part has a protruding part which protrudes from an attached side end of the connector housing, which is at a side attached to the flat cable, toward an extending direction of the flat cable.

4 Claims, 4 Drawing Sheets

(51) Int. Cl.

| | |
|---|---|
| *H01R 12/59* | (2011.01) |
| *H01R 13/405* | (2006.01) |
| *H01R 43/24* | (2006.01) |

(56) References Cited

U.S. PATENT DOCUMENTS

| | | | | |
|---|---|---|---|---|
| 5,267,878 | A * | 12/1993 | Shinji | H01R 9/032 439/607.5 |
| 6,064,003 | A * | 5/2000 | Moore | B60R 16/0207 16/2.1 |
| 2002/0031934 | A1 | 3/2002 | Hara et al. | |
| 2002/0115328 | A1* | 8/2002 | Wakata | H01R 13/521 439/271 |
| 2002/0193009 | A1* | 12/2002 | Reed | H01R 9/05 439/684 |
| 2006/0246779 | A1* | 11/2006 | Helbok | H01R 3/5205 439/606 |
| 2006/0264091 | A1* | 11/2006 | Sakiyama | H01R 12/616 439/404 |
| 2007/0161289 | A1* | 7/2007 | Alloway | B60R 16/0207 439/606 |
| 2009/0247003 | A1 | 10/2009 | Igarashi | |
| 2010/0279541 | A1 | 11/2010 | Osaki et al. | |

FOREIGN PATENT DOCUMENTS

| | | | |
|---|---|---|---|
| JP | 7-106016 | A | 4/1995 |
| JP | 2001-057403 | A | 2/2001 |
| JP | 2002-93515 | A | 3/2002 |
| JP | 2002-170627 | A | 6/2002 |
| JP | 2002-170630 | A | 6/2002 |
| JP | 4387055 | B2 | 12/2009 |
| JP | 2010-123513 | A | 6/2010 |

OTHER PUBLICATIONS

International Search Report (PCT/ISA/210), dated Jul. 24, 2012, issued by the International Searching Authority in counterpart International Patent Application No. PCT/JP2012/060637.

Written Opinion (PCT/ISA/237), dated Jul. 24, 2012, issued by the International Searching Authority in counterpart International Patent Application No. PCT/JP2012/060637.

Communication from the State Intellectual Property Office of P.R. China dated Apr. 3, 2015 in a counterpart application No. 201280018919.2.

Communication from the Japanese Patent Office dated Jan. 13, 2015 in a counterpart Japanese application No. 2011-093664.

Office Action, Issued by the Korean Intellectual Property Office, Dated Dec. 26, 2014, in counterpart Korean Application No. 10-2013-7027317.

Office Action dated Jun. 29, 2015, issued by the Korean Intellectual Property Office in counterpart Korean patent application No. 10-2013-7027317.

* cited by examiner

WATERPROOF FLAT CABLE CONNECTOR AND METHOD FOR MANUFACTURING SAME

CROSS REFERENCE TO RELATED APPLICATIONS

This application is a continuation of PCT application No. PCT/JP2012/060637, which was filed on Apr. 19, 2012 based on Japanese Patent Application (No. P2011-093664) filed on Apr. 20, 2011, the contents of which are incorporated herein by reference.

BACKGROUND OF THE INVENTION

1. Field of the Invention

The present invention relates to a waterproof flat cable connector and a method of manufacturing the waterproof flat cable connector.

2. Description of the Related Art

Traditionally, to make it possible to wire in a narrow space, a flat cable which is formed into a flat board-like shape and has flexibility is used. In the flat cable, terminals which are connected to connection mating terminals of a connection mating connector are connected to exposed parts of conductive wires of the flat cable. It is necessary to perform waterproofing treatment on the junction parts of the conductive wires and the terminals. Therefore, a waterproof flat cable connector, in which the junction parts of the conductive wires and terminals are sealed by synthetic resin, is proposed in JP-A-2010-123513.

In the waterproof flat cable connector described in the patent document 1, all around the junction parts of conductive wires and terminals is integrally molded of synthetic resin to form a molded part, and a rubber plug is provided between the molded part and the inner surface of a connector housing.

SUMMARY OF THE INVENTION

However, as shown in FIG. 6, in a waterproof flat cable connector 100 described in JP-A-2010-123513, a molded part 120, which is liable to receive a load because a flat cable 110 is bended, is fixed to a connector housing 140 through a rubber plug 130 until an end 120*a* (at the side attached to the flat cable 110) of the molded part 120. Therefore, the molded part 120 will not follow the flat cable 110 which is bended, the molded part 120 may be detached from the flat cable 110 or the molded part 120 may become cracked, and as a result there is a problem which is that waterproofness is lowed.

The present invention is made in view of the above situations, and an object of the present invention is to provide a waterproof flat cable connector and a method of manufacturing the waterproof flat cable connector so that waterproofness can be improved.

The above object of the invention is achieved by the following constructions.

(1) A waterproof flat cable connector comprising:

a flexible flat cable which has a conductive wire and an insulative film which covers the conductive wire;

a terminal which is connected to the conductive wire;

an insulative covering part integrally molded with the flat cable to cover a junction part of the conductive wire and the terminal; and a connector housing which is fitted with a connection mating connector to connect the terminal with a connection mating terminal, wherein the connector housing is integrally molded with a surface of the insulative covering part; and wherein the insulative covering part has a protruding part which protrudes from an attached side end of the connector housing, which is at a side attached to the flat cable, toward an extending direction of the flat cable.

(2) The waterproof flat cable connector according to the above (1), wherein the protruding part has a taper part whose thickness is gradually reduced toward an end of the protruding part and which is formed at an end part of the protruding part.

(3) The waterproof flat cable connector according to the above (1) or (2), wherein the insulative covering part is formed of a material whose elasticity is higher than that of the connector housing.

(4) A method for manufacturing a waterproof flat cable connector which including a flexible flat cable which has a conductive wire and an insulative film which covers the conductive wire, a terminal which is connected to the conductive wire, an insulative covering part integrally molded with the flat cable to cover a junction part of the conductive wire and the terminal, and a connector housing which is fitted with a connection mating connector to connect the terminal with a connection mating terminal, the method comprising:

an insulative covering part integrally molding step, in which the insulative covering part is integrally molded with the flat cable to have a protruding part which protrudes from an attached side end of the connector housing, which is at a side attached to the flat cable, toward an extending direction of the flat cable; and a connector housing integrally molding step, in which the connector housing is integrally molded with a surface of the insulative covering part.

In the waterproof flat cable connector of the construction of the above (1), the connector housing is integrally molded with the surface of the insulative covering part, and the insulative covering part includes the protruding part which protrudes from the attached side end (at the side attached to the flat cable) of the connector housing toward the extending direction of the flat cable. Thus, because the flat cable is held in the protruding part which is a part that protrudes toward the direction in which the flat cable extends, the end of the insulative covering part, which is liable to receive a load because the flat cable is bended, is moved to a position apart from the end of the connector housing. Therefore, even if detachment or cracks occur at the protruding part since the end of the insulative covering part is a starting point, because there is a distance from the end to the junction parts, the detachment or the cracks are unlikely to reach the junction part, and as a result, waterproofness can be improved.

For the waterproof flat cable connector of the construction of the above (2), while the same effect as that of the construction of the above (1) is achieved, the protruding part has the taper part which is formed at the end part of the protruding part and whose thickness is gradually reduced toward the end of the protruding part. Therefore, because the insulative covering part is easy to follow the flat cable which is bended, detachment or cracks are unlikely to occur, and as a result, waterproofness can be improved.

For the waterproof flat cable connector of the construction of the above (3), while the same effects as those of the constructions of the above (1) and (2) are achieved, the insulative covering part is formed of a material whose elasticity is higher than that of the connector housing. Therefore, because the protruding part is easy to follow the flat cable which is bended, detachment or cracks are unlikely to occur, and as a result, waterproofness can be improved.

The method of manufacturing the waterproof flat cable connector of the construction of the above (4) includes an insulative covering part integrally molding step, in which the insulative covering part is integrally molded with the flat cable to have the protruding part which protrudes from the side of the boundary of the connector housing with the flat cable toward the direction in which the flat cable extends, and a connector housing integrally molding step, in which the connector housing is integrally molded with the surface of the insulative covering part. Thus, because the flat cable is held in the protruding part which is a part that protrudes toward the direction in which the flat cable extends, the end of the insulative covering part, which is liable to receive a load because the flat cable is bended, can be moved to a position apart from the end of the connector housing. Therefore, even if detachment or cracks occur at the protruding part since the end of the insulative covering part is a starting point, because there is a distance from the end to the junction parts, the detachment or the cracks are unlikely to reach the junction parts, and as a result, waterproofness can be improved.

EMBODIMENTS OF THE INVENTION

Next, preferred embodiments of the flat cable waterproofing connector and the method of manufacturing the waterproof flat cable connector of the present invention will be described in detail with reference to the figures.

DETAILED DESCRIPTION OF THE EXEMPLARY EMBODIMENTS

Embodiment

Figure 1:
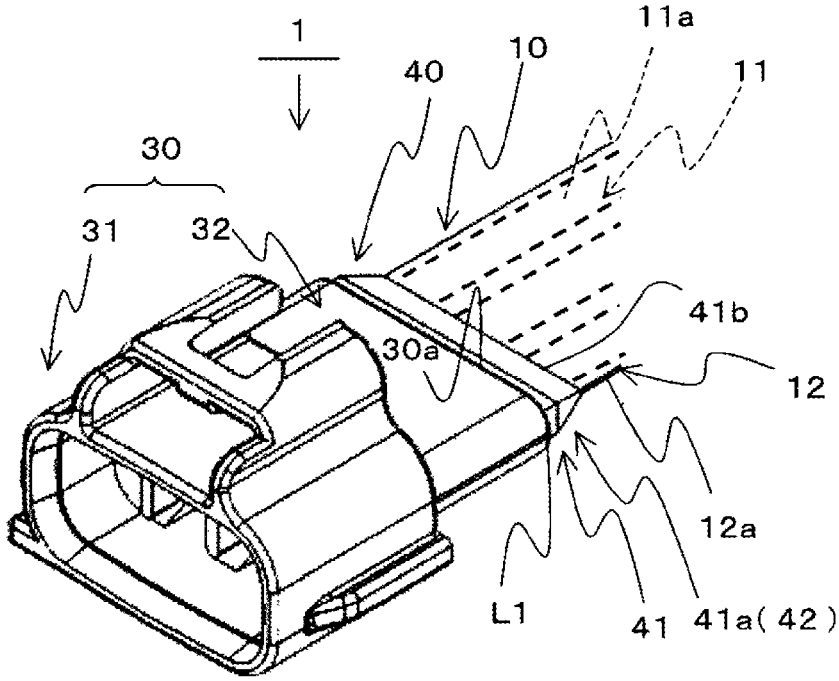
FIG. 1 is a perspective view of a waterproof flat cable connector according to an embodiment of the prevent invention.
Figure 2:
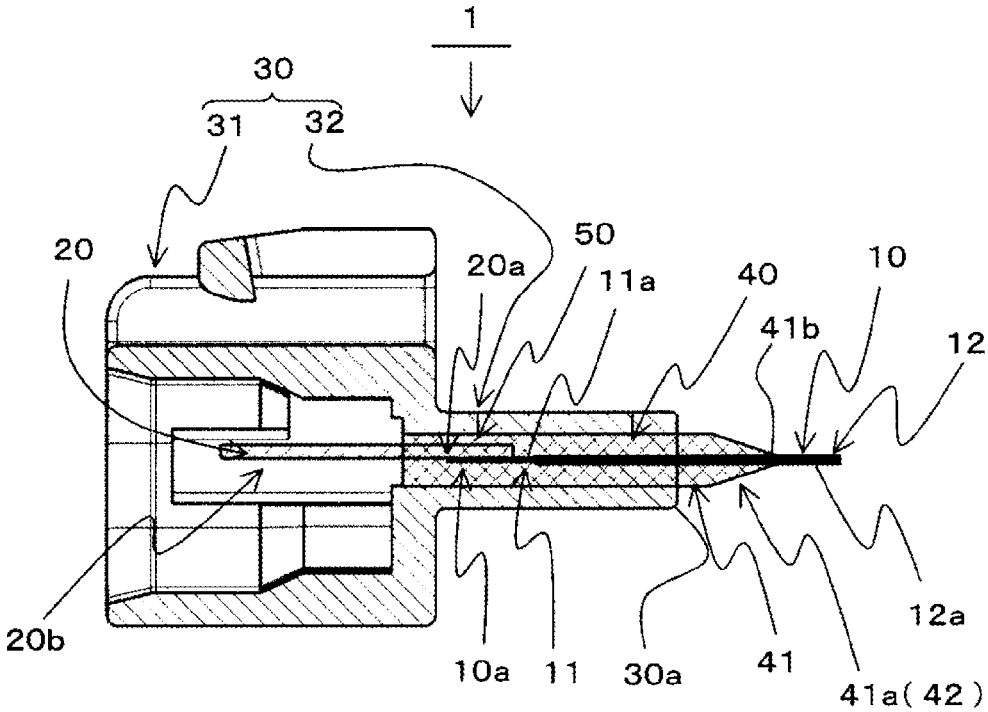
FIG. 2 is a side partial sectional view of the waterproof flat cable connector shown in FIG. 1.

As shown in FIGS. 1 and 2, a waterproof flat cable connector according to the embodiment of the prevent invention includes a flat cable 10, three terminals 20, a connector housing 30 and an insulative covering part 40.

Firstly, the flat cable 10 is described. The flat cable 10 includes a conductor part 11 and an insulation part 12.

The conductor part 11 is formed of copper, copper alloy or the like, and includes three conductive wires 11*a* which have flexibility. These three conductive wires 11*a* are provided in parallel to each other with an interval corresponding to the parallel interval between the terminals 20.

It is illustrated in the embodiment that the conductor part 11 includes three conductive wires 11*a*, but the prevent invention is not limited to the embodiment. In other words, the number of the conductive wires 11*a* may be one or more.

The insulation part 12 is an insulation film 12*a* such as polypropylene by which the conductor part 11 is covered.

The conductor part 11 is covered by the insulation film 12*a* so that the flat cable 10 is formed into a flat board-like shape and has flexibility. In the flat cable 10, the part of the insulation film 12*a* at an end part 10*a* (at the side connected to the terminals 20) is removed so that the conductive wires 11*a* are exposed, and the terminals 20 are connected to the exposed conductive wires 11*a*.

Next, the three terminals 20 will be described. The three terminals 20 have shapes corresponding to the conductive wires 11*a*, and are respectively connected to the conductive wires 11*a* by an ultrasonic welding or crimping method or the like. In the embodiment, the terminals 20 are male terminals, and end parts 20*b* opposite to end parts 20*a*, which are connected to the conductive wires 11*a*, are connected to connection mating terminals of a connection mating connector (not shown in the figure)

It is illustrated in the embodiment that the waterproof flat cable connector 1 includes three terminals 20, but the prevent invention is not limited to the embodiment. In other words, the number of the terminals 20 should be provided to correspond to the number of the conductive wires 11*a*.

Next, the connector housing 30 will be described. The connector housing 30 is made of synthetic resin having rigidity, and is fitted with the connection mating connector (not shown in the figure) so that the terminals 20 are connected to the connection mating terminals (not shown in the figure).

The connector housing 30 includes a fitting part 31 which is fitted with the connection mating connector (not shown in the figure) and a cable holding part 32 which holds the flat cable 10.

The fitting part 31 has a tube-like shape whose sectional outer shape is elliptic, and the connection mating connector (not shown in the figure) is fitted inside the fitting part 31. In other words, by fitting the connection mating connector (not shown in the figure) into the fitting part 31, the terminals 20 are connected to the connection mating terminals (not shown in the figure) which the connection mating connector is provided with.

The cable holding part 32 is a part that contains junction parts 50 of the conductive wires 11*a* and the terminals 20, and holds the end parts 10*a* (at the sides connected to the terminals 20) of the flat cable 10.

The connector housing 30 is integrally molded with the surface of the insulative covering part 40.

Next, the insulative covering part 40 will be described. The insulative covering part 40 is formed of insulation material such as rubber material or thermoplastic elastomer material whose elasticity is higher than that of the connector housing 30.

Figure 3:
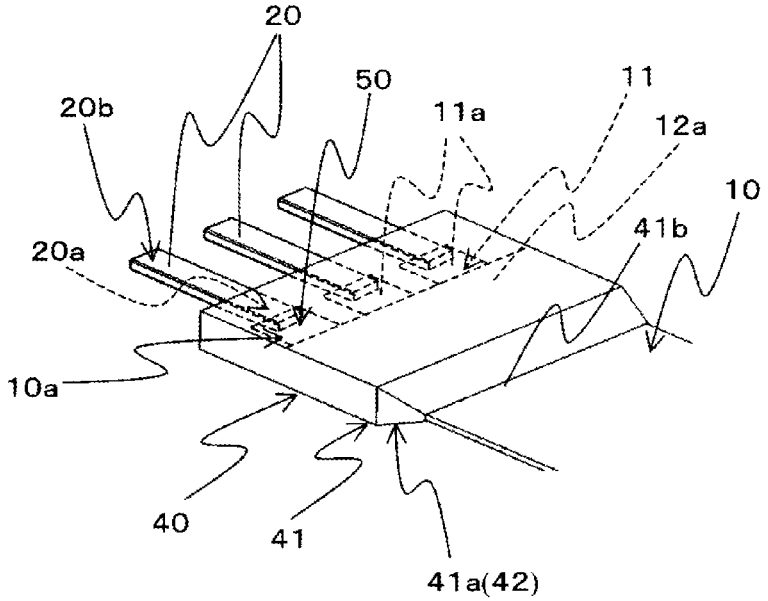
FIG. 3 is an enlarged perspective view of main parts which illustrates the area around the insulative covering part shown in FIG. 1.

The insulative covering part 40, as shown in FIG. 3, is integrally molded with the flat cable 10 to cover the junction parts 50.

As shown in FIGS. 1 and 2, the insulative covering part 40 has a protruding part 41. The protruding part 41 is a part which protrudes from an attached side end 30*a* (which is the end at the side attached to the flat cable 10) of the connector housing 30 toward a direction in which the flat cable 10 extends. Because the flat cable 10 is held in the protruding part 41, an end 41*b* of the insulative covering part 40, which is liable to receive a bad because the flat cable 10 is bended, is moved to a position apart from the junction parts 50.

Because the insulative covering part 40 is formed of a material whose elasticity is higher than that of the connector housing 30, the protruding part 41 is easy to follow the flat cable 10 which is bended.

In addition, the protruding part 41 has a taper part 42. An end part 41*a* of the protruding part 41 is formed with the taper part 42, and the taper part 42 is a part whose thickness is gradually reduced toward the end 41*b* of the protruding part 41. Thus, because the taper part 42 is provided, the thickness of the end part 41*a* of the protruding part 41 is reduced so that the rigidity is lowered, and it is easy for the protruding part 41 to follow the flat cable 10 which is bended. Therefore, the insulative covering part 40 will not be easily detached from the flat cable 10, and the insulative covering part 40 will not easily become cracked.

Figure 4:
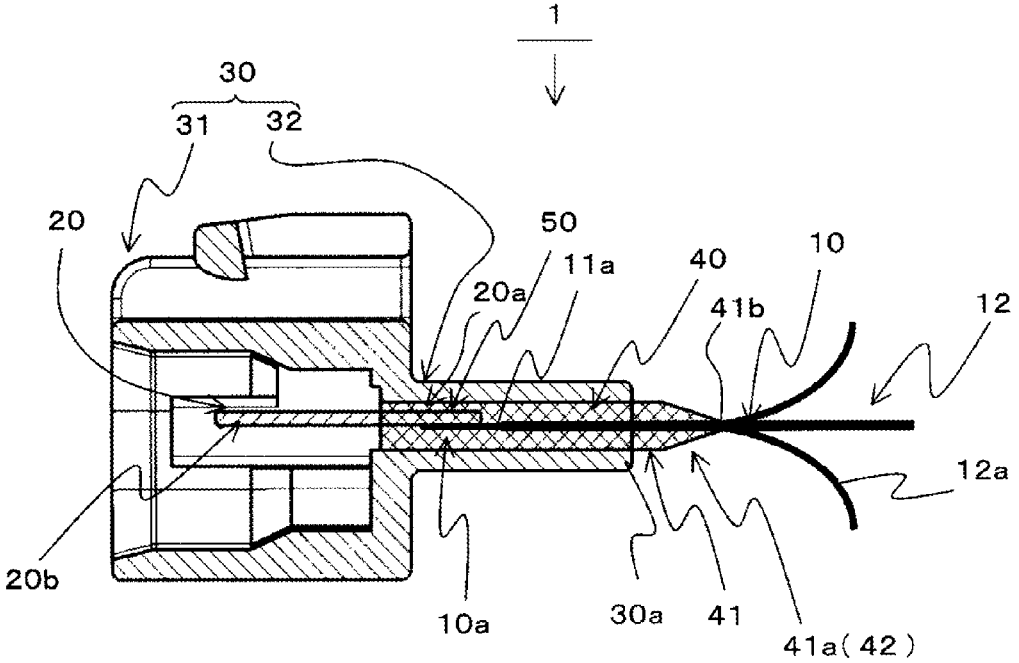
FIG. 4 is a figure which illustrates that the flat cable of the waterproof flat cable connector shown in FIG. 1 is bended.

In the waterproof flat cable connector 1, as shown in FIG. 4, because the flat cable 10 is held in the protruding part 41 which protrudes toward a direction in which the flat cable 10 extends, the end 41*b* of the insulative covering part 40, which is liable to receive a load because the flat cable 10 is bended, is moved to a position apart from the junction parts 50. Therefore, even if detachment or cracks occur at the protruding part 41 since the end 41*b* of the insulative covering part 40 is a starting point, because there is a distance from the end 41*b* to the junction parts 50, the detachment or the cracks are unlikely to reach the junction parts 50.

Because the insulative covering part 40 is formed of a material whose elasticity is higher than that of the connector housing 30, and the end part 41*a* of the protruding part 41 is provided with the taper part 42, the protruding part 41 is easy to follow the flat cable 10 which is bended. Therefore, the insulative covering part 40 will not be easily detached from the flat cable 10, and the insulative covering part 40 will not easily become cracked.

Figure 5A:
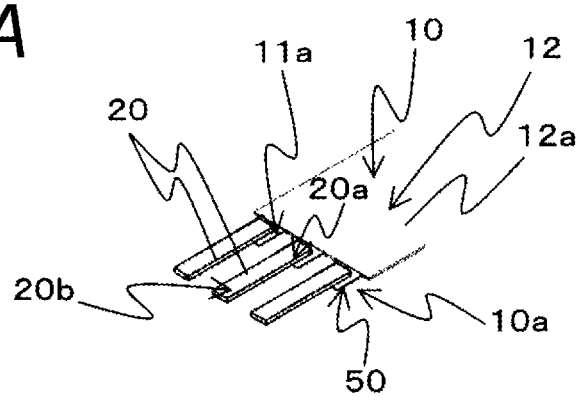
FIGS. 5A to 5C are drawings which illustrate a method of manufacturing the waterproof flat cable connector shown in FIG. 1.

Next, the method of manufacturing the waterproof flat cable connector 1 will be described by using FIG. 5. FIG. 5 is a figure which shows the method of manufacturing the waterproof flat cable connector 1 shown in FIG. 1.

Firstly, the part of the insulation film 12*a* at the end parts 10*a* (at the side connected to the terminals 20) of the flat cable 10 is removed to expose the end parts of the conductive wires 11*a*. Then, the exposed end parts of the conductive wires 11*a* and the terminals 20 are bonded together by an ultrasonic welding or crimping method or the like (refer to FIG. 5A).

Figure 5B:
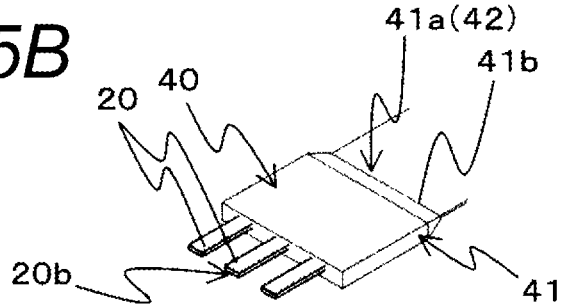

After that, the insulative covering part 40 is integrally molded with the flat cable 10 to cover the junction parts 50 of the conductive wires 11*a* and the terminals 20 (refer to FIG. 5B). When the insulative covering part 40 is molded, the insulative covering part 40 including the protruding part 41 is integrally molded with the flat cable 10.

Figure 5C:
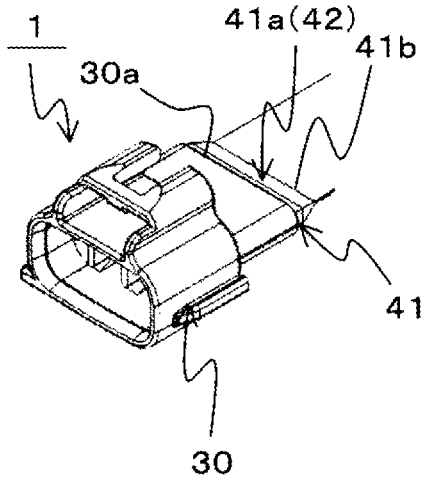
Figure 6:
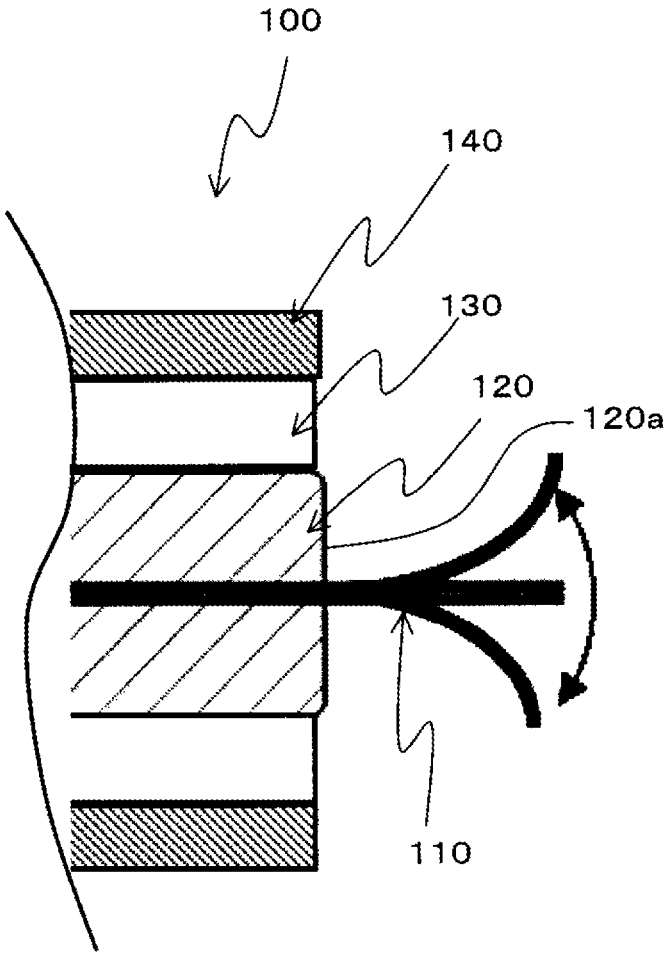
FIG.6 PRIOR ART
FIG. 6 is a drawings to describe a related technique.

After that, the connector housing 30 is integrally molded with the surface of the insulative covering part 40 (refer to FIG. 5C).

In the waterproof flat cable connector 1 of the embodiment, the connector housing 30 is integrally molded with the surface of the insulative covering part 40, and the insulative covering part 40 includes the protruding part 41 which protrudes from the attached side end (at the side attached to the flat cable 10) of the connector housing 30 toward the direction in which the flat cable 10 extends. Thus, because the flat cable 10 is held in the protruding part 41 which protrudes toward the direction in which the flat cable 10 extends, the end 41*b* of the insulative covering part 40, which is liable to receive a load because the flat cable 10 is bended, is moved to a position apart from the junction parts 50. Therefore, even if detachment or cracks occur at the protruding part 41 since the end 41*b* of the insulative covering part 40 is a starting point, because there is a distance from the end 41*b* to the junction parts 50, the detachment or the cracks are unlikely to reach the junction parts 50, and as a result, waterproofness can be improved.

In the waterproof flat cable connector 1 of the present embodiment, the protruding part 41 has the taper part 42 formed at the end part 41*a* of the protruding part 41, and the thickness of the taper part 42 is gradually reduced toward the end 41*b* of the protruding part 41. Therefore, because the insulative covering part 40 is easy to follow the flat cable 10 which is bended, detachment or cracks are unlikely to occur, and as a result, waterproofness can be improved.

In addition, in the waterproof flat cable connector 1 of the prevent embodiment, the insulative covering part 40 is formed of a material whose elasticity is higher than that of the connector housing 30. Thus, because the protruding part 41 is easy to follow the flat cable 10 which is bended, detachment or cracks are unlikely to occur, and as a result, waterproofness can be improved.

The method of manufacturing the waterproof flat cable connector 1 of the prevent embodiment includes an insulative covering part integrally molding step, in which the insulative covering part 40 is integrally molded with the flat cable 10 to have the protruding part 41 which protrudes from the attached side end 30*a* (at the side attached to the flat cable 10) of the connector housing 30 toward the direction in which the flat cable 10 extends, and a connector housing integrally molding step, in which the connector housing 30 is integrally molded with the surface of the insulative covering part 40. Thus, because the flat cable 10 is held in the protruding part 41 which protrudes toward the direction in which the flat cable 10 extends, the end 41*b* of the insulative covering part 40, which is liable to receive a load because the flat cable 10 is bended, can be moved to a position apart from the junction parts 50. Therefore, even if detachment or cracks occur at the protruding part 41 since the end 41*b* of the insulative covering part 40 is a starting point, because there is a distance from the end 41*b* to the junction parts 50, the detachment or the cracks are unlikely to reach the junction parts 50, and as a result, waterproofness can be improved.

In the method of manufacturing the waterproof flat cable connector 1 of the prevent embodiment, the insulative covering part integrally molding step includes a taper part forming step, in which the taper part 42 is formed so that the thickness of the end part 41*a* of the protruding part 41 is gradually reduced toward the end 41*b* of the protruding part 41. Therefore, because the insulative covering part 40 is easy to follow the flat cable 10 which is bended, detachment or cracks are unlikely to occur, and as a result, waterproofness can be improved.

In the waterproof flat cable connector 1 of the prevent embodiment, the terminals 20 are illustrated as male terminals, but the present invention is not limited to the illustration and the terminals 20 may be female terminals.

In the waterproof flat cable connector 1 of the prevent embodiment, the connector housing 30 is illustrated to include the tube-like fitting part 31 whose sectional outer shape is elliptic, and in which the connection mating connector (not shown in the figure) is inserted, but the present invention is not limited to the illustration. In other words, the fitting part may have other shapes as long as the connection mating connector can be fitted to the fitting part.

The invention accomplished by the inventor is described in detail based on the above embodiment of the invention, but the present invention is not limited to the above embodiment of the invention and can be modified in various ways without departing from the spirit of the invention.

According to the waterproof flat cable connector and the method of manufacturing the waterproof flat cable connector of the present invention, even if detachment or cracks occur at the protruding part since the end of the insulative covering part is a starting point, because there is a distance from the end to the junction parts, the detachment or the cracks are unlikely to reach the junction parts, and as a result, waterproofness can be improved.

What is claimed is:

1. A waterproof flat cable connector comprising:

a flexible flat cable including a conductive wire and an insulative film covering the conductive wire;

a terminal connected to the conductive wire;

an insulative covering part integrally provided with the flat cable to cover a junction part of the conductive wire and the terminal; and a connector housing fitted with a connection mating connector to connect the terminal with a connection mating terminal, wherein the connector housing is integral with a surface of the insulative covering part;

wherein the insulative covering part includes a protruding part which protrudes from an attached side end of the connector housing, which is at a side attached to the flat cable, toward an extending direction of the flat cable; and wherein the protruding part of the insulative covering part is not covered with the connector housing.

2. The waterproof flat cable connector according to claim 1, wherein the protruding part has a taper part whose thickness is gradually reduced toward an end of the protruding part and which is formed at an end part of the protruding part.

3. The waterproof flat cable connector according to claim 1, wherein the insulative covering part has an elasticity that is higher than that of the connector housing.

4. A method for manufacturing a waterproof flat cable connector which including a flexible flat cable which has a conductive wire and an insulative film which covers the conductive wire, a terminal which is connected to the conductive wire, an insulative covering part integrally molded with the flat cable to cover a junction part of the conductive wire and the terminal, and a connector housing which is fitted with a connection mating connector to connect the terminal with a connection mating terminal, the method comprising:

integrally molding the insulative covering part with the flat cable to have a protruding part which protrudes from an attached side end of the connector housing, which is at a side attached to the flat cable, toward an extending direction of the flat cable, wherein the protruding part of the insulative covering part is not covered with the connector housing; and integrally molding the connector housing with a surface of the insulative covering part.

* * * * *